US012583571B2

(12) United States Patent
Artigues et al.

(10) Patent No.: US 12,583,571 B2
(45) Date of Patent: Mar. 24, 2026

(54) MOTION TRANSFORMING DIFFERENTIALLY BIASED TRANSMISSION FOR HUMAN POWERED VEHICLES

(71) Applicants: Paul Laurent Artigues, Auburn, GA (US); Robert Rue Emrich, II, Lindale, TX (US)

(72) Inventors: Paul Laurent Artigues, Auburn, GA (US); Robert Rue Emrich, II, Lindale, TX (US)

( * ) Notice: Subject to any disclaimer, the term of this patent is extended or adjusted under 35 U.S.C. 154(b) by 506 days.

(21) Appl. No.: 18/178,512

(22) Filed: Mar. 5, 2023

(65) Prior Publication Data

US 2024/0294243 A1 Sep. 5, 2024

(51) Int. Cl.

| | |
|---|---|
| ***B63H 23/12*** | (2006.01) |
| ***B63H 16/20*** | (2006.01) |
| ***B63H 21/17*** | (2006.01) |
| ***B63H 21/20*** | (2006.01) |
| ***B63H 21/21*** | (2006.01) |
| *B63H 23/02* | (2006.01) |

(52) U.S. Cl.

CPC ..... *B63H 23/12* (2013.01); *B63H 16/20* (2013.01); *B63H 21/17* (2013.01); *B63H 21/20* (2013.01); *B63H 21/21* (2013.01); *B63H 2016/202* (2013.01); *B63H 2023/0216* (2013.01); *B63H 2023/025* (2013.01)

(58) Field of Classification Search

CPC ..... B63H 23/12; B63H 16/20; B63H 21/17; B63H 21/20

See application file for complete search history.

(56) References Cited

U.S. PATENT DOCUMENTS

| | | | | | |
|---|---|---|---|---|---|
| 2,158,349 | A * | 5/1939 | Allen | B63H 16/14 | 74/136 |
| 4,427,392 | A | 1/1984 | Schneider | | |
| 4,968,274 | A * | 11/1990 | Gregory | B63B 1/121 | 440/27 |
| 5,242,181 | A | 9/1993 | Fales et al. | | |

(Continued)

FOREIGN PATENT DOCUMENTS

| | | | | |
|---|---|---|---|---|
| BR | 112019018419 A2 * | 4/2020 | | B63B 1/246 |
| CN | 210416939 | 8/2019 | | |

(Continued)

*Primary Examiner* — S. Joseph Morano
*Assistant Examiner* — Jovon E Hayes

(57) ABSTRACT

A transmission for a human-powered vehicle. The transmission has a primary system that includes a transmission case, a crankshaft with cog, a pair of receiver cranks, a pair of connecting rods, a pair of oscillating driver cranks, and a pair of pedals. A secondary biasing system is engaged with the primary system to provide a favorable torque around dead centers of the primary system. The transmission 150 may be configured to transmit power by driveshaft, chain, or belt to drive a wheel or propeller. In a watercraft application, an operator alternatingly applies force to a pair of pedals while seated close to the floor of a kayak 145. Power from the transmission is transmitted through a steerable lower gear case 134 via a propeller to propel the craft. The operator maneuvers the craft by means of a control lever 135 operably connected to the lower gear case by cables 136.

11 Claims, 11 Drawing Sheets

(56) References Cited

U.S. PATENT DOCUMENTS

| | | | | |
|---|---|---|---|---|
| 5,282,762 | A * | 2/1994 | Cerreto | B63H 16/14 440/31 |
| 5,460,551 | A * | 10/1995 | Beres | B63H 16/14 D12/302 |
| 6,022,249 | A * | 2/2000 | Ketterman | B63H 16/12 440/13 |
| 6,165,029 | A * | 12/2000 | Lu | B63H 25/10 440/30 |
| 6,171,157 | B1 * | 1/2001 | Knapp | B63H 16/14 440/28 |
| 6,237,928 | B1 | 5/2001 | Islas | |
| 6,241,565 | B1 | 6/2001 | Doroftel | |
| 6,712,653 | B2 | 3/2004 | Free | |
| 6,855,016 | B1 * | 2/2005 | Jansen | B63H 21/17 440/27 |
| 6,997,765 | B1 | 2/2006 | McGuiness | |
| 8,231,418 | B2 * | 7/2012 | Okabe | B63H 20/20 440/75 |
| 8,517,405 | B2 | 8/2013 | Yan | |
| 8,668,536 | B1 | 3/2014 | Burnham | |
| 8,725,329 | B1 * | 5/2014 | Snyder | B63H 21/20 440/6 |
| 9,290,233 | B2 | 3/2016 | Goin | |
| 9,359,052 | B2 | 6/2016 | Ketterman et al. | |
| 9,475,559 | B2 | 10/2016 | Czarnowski et al. | |
| 9,725,149 | B2 | 8/2017 | Kiffmeyer et al. | |
| 9,796,464 | B1 | 10/2017 | Sand | |
| 10,239,577 | B2 | 3/2019 | Johannessen | |
| 10,259,553 | B2 | 4/2019 | Dow et al. | |
| 10,266,237 | B2 | 4/2019 | Zimmerman et al. | |
| 10,442,514 | B2 | 10/2019 | Chen | |
| 10,780,965 | B2 | 9/2020 | Li | |
| 10,913,521 | B1 | 2/2021 | Maresh | |
| 11,034,423 | B2 | 6/2021 | Pelland et al. | |
| 11,148,775 | B2 | 10/2021 | Kuchmichael | |
| 11,485,465 | B1 | 11/2022 | Maresh | |
| 2008/0132127 | A1 * | 6/2008 | Jansen | B63B 34/50 320/101 |

FOREIGN PATENT DOCUMENTS

| | | |
|---|---|---|
| CN | 111055986 | 12/2019 |
| WO | WO 03/091098 | 11/2003 |

* cited by examiner

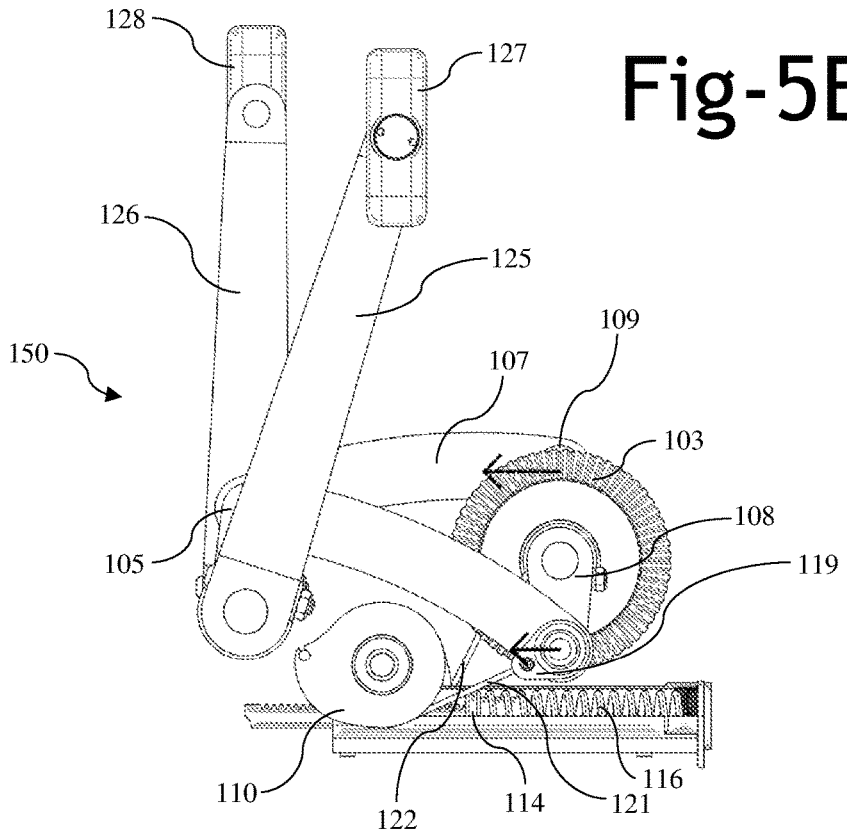
Fig-5E
Fig-5F
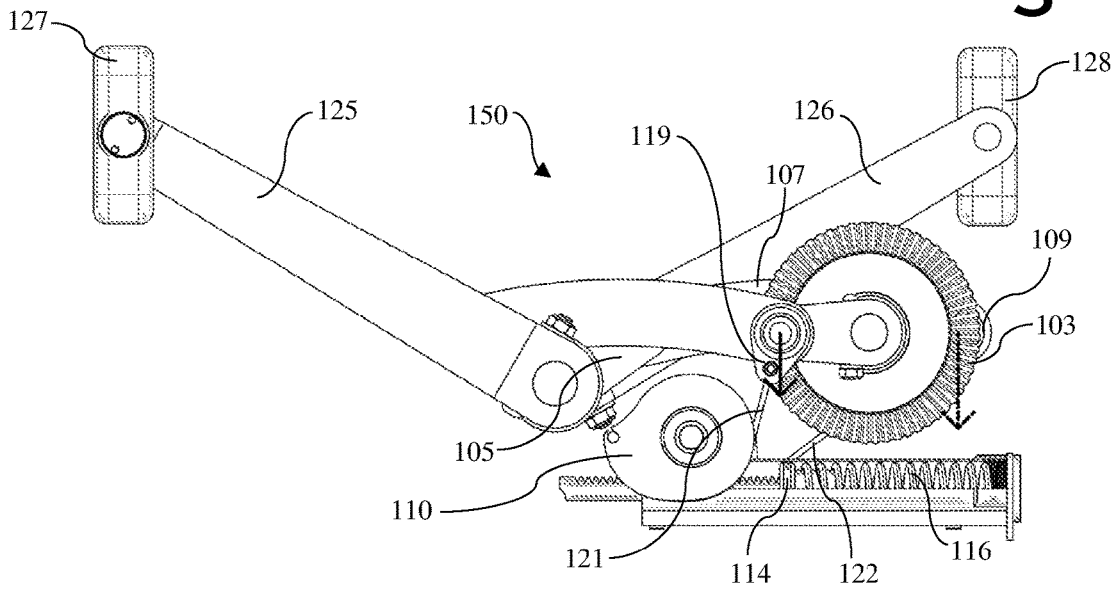

MOTION TRANSFORMING DIFFERENTIALLY BIASED TRANSMISSION FOR HUMAN POWERED VEHICLES

CROSS REFERENCE TO RELATED APPLICATIONS

This application claims the benefit of U.S. Provisional Patent Application No. 63/320,122, filed Mar. 15, 2022, which is incorporated by reference herein in its entirety.

BACKGROUND OF THE INVENTION

I. Field of the Invention

The present invention relates generally to the field of mechanical power transmission. More particularly the present invention relates to the translation of an oscillating alternating input to a continuous rotational output and is ideally suited for the propulsion of human powered vehicles.

Small watercraft, recumbent bicycles, pedal cars, and other human powered vehicles are immensely popular throughout the world and provide mobility, exercise, recreational pleasure, and produce many economic benefits to society. The present invention offers high efficiency of power transmission, is inherently light weight, requires minimal maintenance, is capable of withstanding high torque loads, provides for a low center of gravity, affords an ergonomically superior seating position, and allows for significant improvement in maneuverability.

II. Description of the Related Art

The field of design related to translating human muscle power to motive force has a long history with the origin of oars dating to Neolithic times. Foot treadle paddle boats can be traced back at least to 573. Human powered propulsion by propeller is illustrated as early as the late 1700's by David Bushnell and his submarine the "Turtle". It has long been recognized that the power generated, and endurance of human leg muscles far exceed the capability of the arm muscles.

With the advent of the bicycle, it was quite obvious that pedal cranks were a viable improvement for power input on both land and water as evident in patents to Townsend (U.S. Pat. No. 94,363), and Curlin (U.S. Pat. No. 315,743). Most designs for pedal powered recumbent style vehicles have been a direct application of bicycle drivetrain technology and are of the rotary input to rotary output type as can be seen in patents to Schneider (U.S. Pat. No. 4,427,392), Gregory (U.S. Pat. No. 4,968,274), Cerretto (U.S. Pat. No. 5,282,762), Beres (U.S. Pat. No. 5,460,551), Lu (U.S. Pat. No. 6,165,029), Free (U.S. Pat. No. 6,712,653), Kiffmeyer et al. (U.S. Pat. No. 9,725,149), Zimmerman (U.S. Pat. No. 10,266,237), Li (U.S. Pat. No. 10,780,965), Maresh (U.S. Pat. No. 10,913,521), Pelland (U.S. Pat. No. 11,034,423), and Kuchmichael (U.S. Pat. No. 11,148,775). One shortcoming of these applications is the necessary compromise between seat height and ergonomic comfort. It is desirable to maintain a low center of gravity for stability, but heel clearance dictates that the crank spindle be located a significant height above the ground or the floor of the craft in these designs. Biomechanics may be compromised in arrangements that place the pedals significantly above the operator's waist, and stability is compromised when the seat is elevated.

A rotary input to oscillating output devise is disclosed by Maresh (U.S. Pat. No. 11,485,465) in which a traditional pedal crank arrangement drives an eccentric cam and follower to induce an oscillating motion in a pair of flexible fins. Like conventional systems, the crank spindle must be located sufficiently high in the craft requiring biomechanical, ergonomic, or stability compromises.

Many linear rack and reciprocating arrangements have been presented that allow for a lower pedal height and transform a reciprocating input into a rotary output, such as patents to Knapp (U.S. Pat. No. 6,171,157), Islas (U.S. Pat. No. 6,237,928), Doroftel (U.S. Pat. No. 6,241,565), Bonifacio (WO 03/091098), Sand (U.S. Pat. No. 9,796,464), Goin (U.S. Pat. No. 9,290,233), and Chen (U.S. Pat. No. 10,442,514). These also have short comings, such as the torque and life cycle limitations imposed by the ratcheting over-run clutches or one-way bearings that are utilized to rectify the output rotation. Moreover, limits to the reciprocating stroke must be rigidly defined or manipulated by the operator which can lead to damage of the equipment.

Devices of oscillating input and output are also known, such as patents to Ketterman (U.S. Pat. No. 6,022,249), McGuiness (U.S. Pat. No. 6,997,765), Burnham (U.S. Pat. No. 8,668,536), Ketterman et al. (U.S. Pat. No. 9,359,052), Czarnowski et al. (9,475,559), Dow et al. (U.S. Pat. No. 10,259,553), Tang (CN210416939), and Qu et al. (CN111055986). These patents share flexible or pivoting fins and seek to emulate the motion of marine vertebrates. Inherently there are definite limits of stroke which must be avoided by operator manipulation. Furthermore, there is a loss of efficiency as the fins angle of attack must change passing through zero at each stroke reversal. Additionally, there are significant challenges relative to service life and durability when utilizing flexible components in high torque environments.

Several devices of oscillating input to rotary output have been presented. Patent to Allen (U.S. Pat. No. 2,158,349) teaches of the use of opposed over-run clutches arranged on a common shaft to rectify output. Patents to Fales et al. (U.S. Pat. No. 5,242,181), Yan (U.S. Pat. No. 8,517,405), and Johannessen (U.S. Pat. No. 10,239,577) also employ over-run clutches to rectify motion. As with the reciprocating to rotary devices, torque and life cycle limitations of the ratcheting over-run clutches and limits to the oscillating stroke present substantial design challenges.

It is of the oscillating input to rotary output type of transmission for human powered vehicles that the present invention pertains.

BRIEF SUMMARY OF THE INVENTION

In accordance with the present invention and the contemplated obstacles which have existed, and continue to exist in the field, the objective of the present invention is to provide a robust, trouble free, smooth, and efficient transmission for the transformation of oscillating to rotary motion. It is further the objective of the present invention to improve on the maneuverability, safety, ergonomics, and efficiency of human powered vehicles as the present invention offers distinct design alternatives and alleviates many constraints inherent in traditional crank driven systems. The transmission of the present invention is mechanical in nature and is versatile in regard to output configurations and orientations. For watercraft, a vertically oriented output shaft can be employed for directed azimuth propeller propulsion allowing for unparalleled maneuverability. For land vehicles, a horizontal output shaft or traditional chain drive can be employed to drive a wheel. In all cases a lower center of gravity and more ergonomic position can be achieved than with traditional crank arrangements. Unlike other oscillating input devices, the transmission of the present invention does not require limit stops of any kind. The limits of the oscillating driver cranks are inherent in the system and smooth as defined by the continuous rotation of the output crank. It also requires no overrun clutches to rectify motion.

In its preferred embodiment, the present invention utilizes a conventional rocker driven crank mechanism with two rigid connecting rods. However, it departs from convention by the omission of the massive flywheel that is typically employed to carry the output crank through the dead zones of the cycle. To carry out the function normally accomplished by the momentum of a flywheel, an alternate impetus is provided. In the preferred embodiment of the present invention, the crank journals are rotationally coupled to two additional connecting rods which are alternatingly biased, effectively variable in length, and out of phase with the rigid connecting rods. In this embodiment of the present invention, spring tensioned cables are utilized to accomplish said function. The method in which this is accomplished, as well as other features, advantages, and capabilities of the present invention will become apparent from the foregoing description taken in conjunction with the accompanying drawings illustrating the preferred embodiment of the invention.

BRIEF DESCRIPTION OF THE DRAWINGS

The invention will be better understood when consideration is given to the following detailed description referencing the annexed drawings wherein. Like reference numerals have been assigned to relevant parts and are utilized throughout the drawings for clarity. Additionally, many identical parts are given their own unique part number for ease of description and understanding of the operational cycle. Torque vectors in FIGS. 5A through 5F are representative of the torque imparted by the secondary biasing system for a given spring constant. The drive mechanism of the present invention is indicated by the numeral 150.

FIGS. 5A-5F are right side orthogonal views of the dynamic components of the drive mechanism shown in FIG. 4. Vectors represent the torques imparted by the secondary system for the positions shown.

DESCRIPTION OF THE PREFERRED EMBODIMENTS

Figure 1:
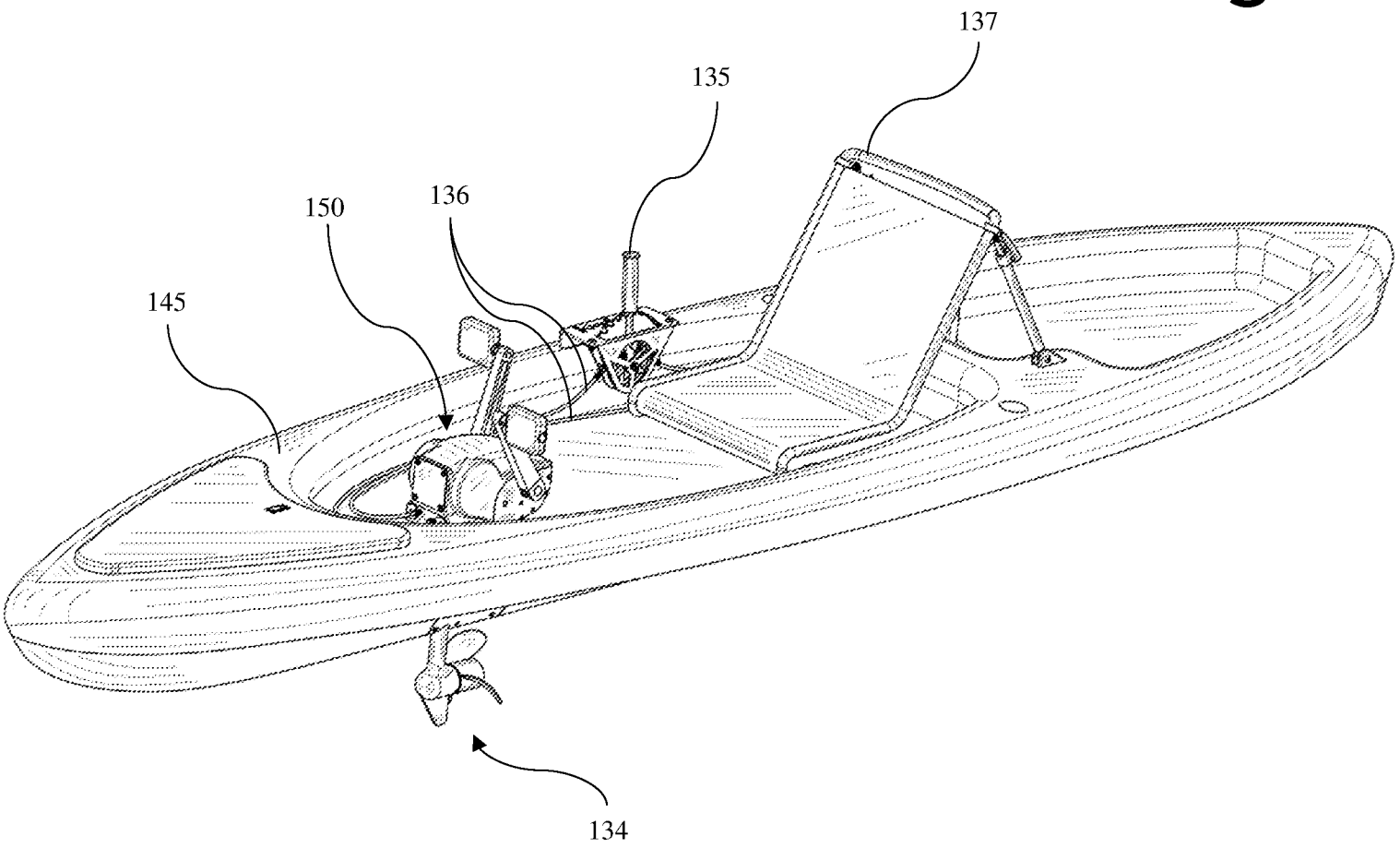
FIG. 1 is a perspective view of the drive mechanism configured to drive a propeller and outfitted to a kayak.
Figure 2:
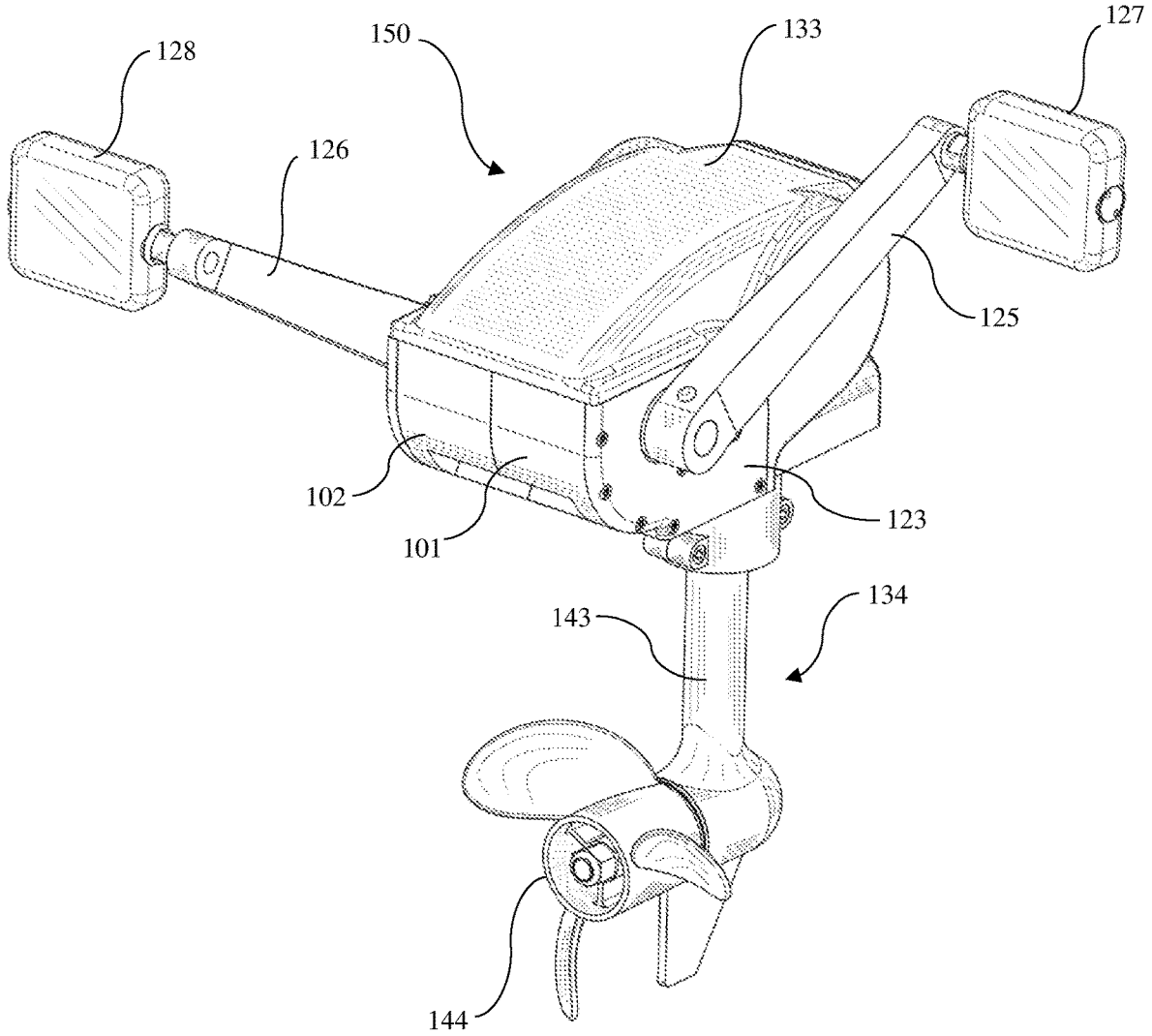
FIG. 2 is a perspective view of the drive mechanism configured to drive a propeller.

For a fuller understanding of the nature, application and function of the present invention, reference should be directed to the following detailed description taken in context with the accompanying drawings. Referring first to FIGS. 1, 2, 3, 6, and 7 for a better understanding of the general construction and application of the preferred embodiment. A transmission case 101, 102 is permanently or temporarily rigidly secured to the hull of a watercraft 145. The operator applies force alternately to pedals 127, 128 which are securely affixed to driver crank arms 125, 126 and coupled to drive mechanism 150. The oscillating power input imparted by the operator is transformed to a continuous rotary output which in turn produces a propulsive thrust via propeller 144. The direction of thrust is controlled by the operator by adjusting the thrust angle of the lower gearbox assembly 134. The lower gearbox assembly 134 is secured within the transmission case 101, 102 by headset bearings 139 and the azimuth angle of propulsion is controlled by directional control lever 135 and directional control cables 136 routed through adjusting barrels 131, 132 and secured in cable spool 138. Power is transmitted from the crank shaft with cog 103 of drive mechanism 150 to upper drive shaft with pinion 140 which in turn by means of mating miter gears 142 drives lower drive shaft 141 coupled to propeller 144. Power may be augmented by addition of an electric motor 146 and peripherals.

Referring now to FIG. 1 which is a perspective representation of the drive mechanism 150 applied to a driven shaft output for screw propulsion with directional thrust capability outfitted to a kayak. Drive mechanism 150 is permanently or temporarily rigidly affixed to kayak hull 145 at an appropriate distance forward of the operator's seat 137 so that a reasonable range of leg lengths can be accommodated with fore-aft adjustment of the operator's seat 137. Power from the transmission is transmitted through a steerable lower gear case assembly 134 via a propeller to propel the craft. The operator maneuvers the craft by means of a control lever 135 operably connected to the lower gear case by cables 136.

Figure 3:
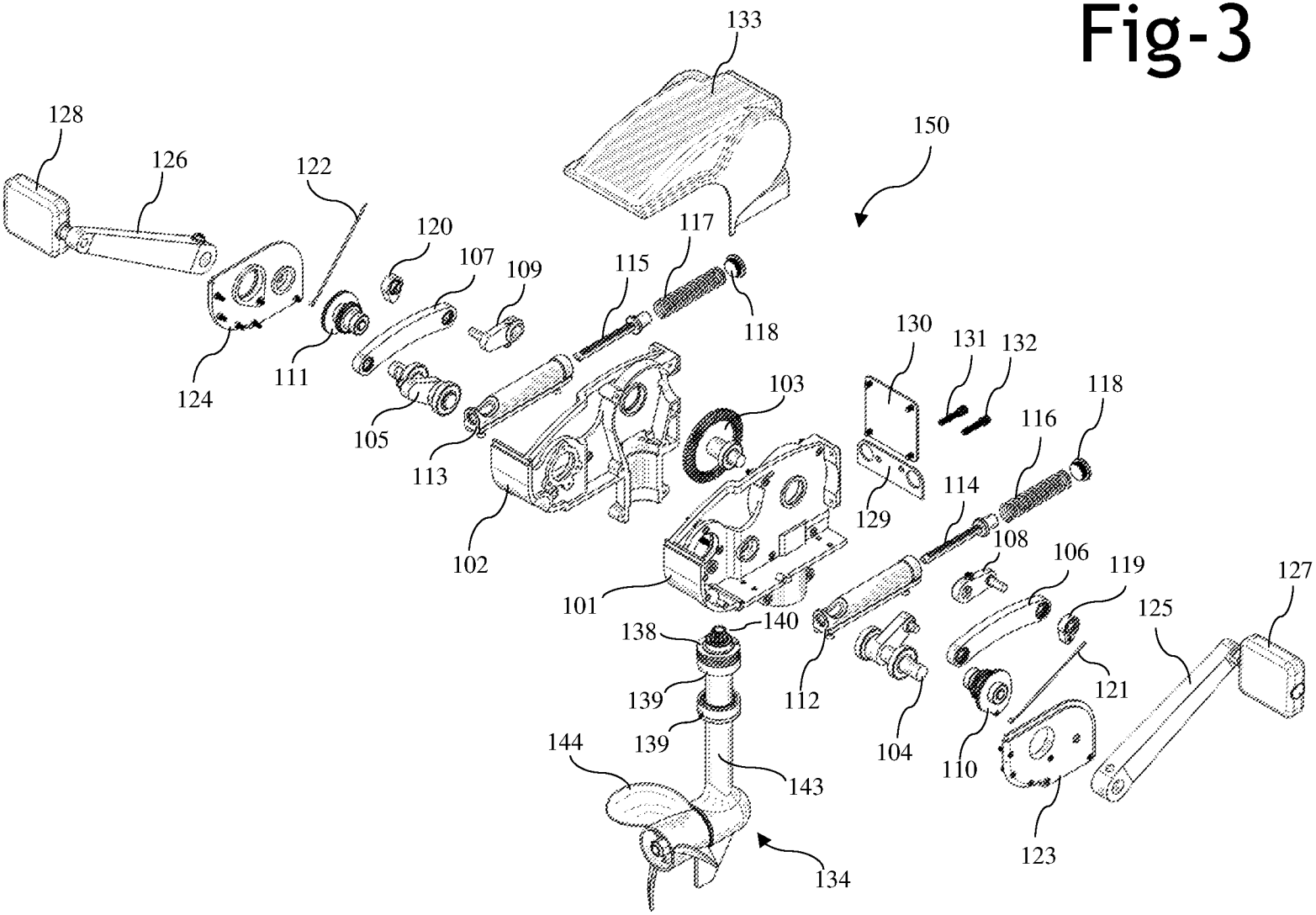
FIG. 3 is an isometric exploded view of the drive mechanism configured to drive a propeller illustrated in FIG. 2.

For a better understanding of the physical form of the components within, reference is directed to FIG. 3 which clearly illustrates the design intent of each component. A transmission case 101, 102 and bearing plates 123, 124 serve as the structural housing for the drive components, and transmission cover 133, transmission cover retainer plate 130, and spring cylinder cover plate 129 are equipped for environmental isolation as well as operator safety. Each rocker spindle 104, 105 is supported and constrained to rotate about its proximal axis between transmission case 101, 102 and bearing plates 123, 124 by its inboard and outboard rocker spindle bearings. Rigidly affixed to the outboard proximal end of each rocker spindle is a driver crank arm 125, 126, each equipped with pedals 127, 128 to receive operator input. Rotationally coupled to the distal end of each rocker spindle is a connecting rod 106, 107. The opposing end of each connecting rod 106, 107 is rotationally coupled to the distal end of its respective receiver crank 108, 109. Each receiver crank 108, 109 is rigidly affixed to the shaft of crank shaft with cog 103 which is supported and constrained to rotate about its axis between transmission case 101, 102 by its shaft bearings. Rotationally affixed to the distal end of each receiver crank 108, 109 and outboard of connecting rods 106, 107 is a cable end receiver 119, 120. Rigidly affixed to right side transmission case 101 and left side transmission case 102 are spring cylinders 112, 113 which slidably constrain piston and gear racks 114, 115. Mounted above each spring cylinder 112, 113 and meshing with the gear rack of each piston and gear rack 114, 115 is a cable spool and pinion 110, 111 which is itself supported and constrained to rotate about its axis between transmission cases 101, 102 and bearing plates 123, 124 by its shaft bearings. A cable 121, 122 is routed from each cable spool and pinion 110, 111 to its respective cable end receiver 119, 120 forming the link between primary and secondary systems. Springs 116, 117 are inserted in the ends of spring cylinders 112, 113 and captivated by spring cylinder end caps 118 thus tensioning the system. Lower gearbox assembly 134 is rotationally mounted between transmission case 101, 102 by bearings 139 and upper drive shaft with pinion 140 is driven by its pinion which meshes with crank shaft with cog 103. Directional cable spool 138 rigidly coupled to lower gearbox case 143 provides means of steering lower gearbox assembly 134 via cables (not shown) routed through adjusting barrels 131, 132. Force is transmitted from drive mechanism 150 through lower gearbox assembly 134 to propeller 144.

Figure 4:
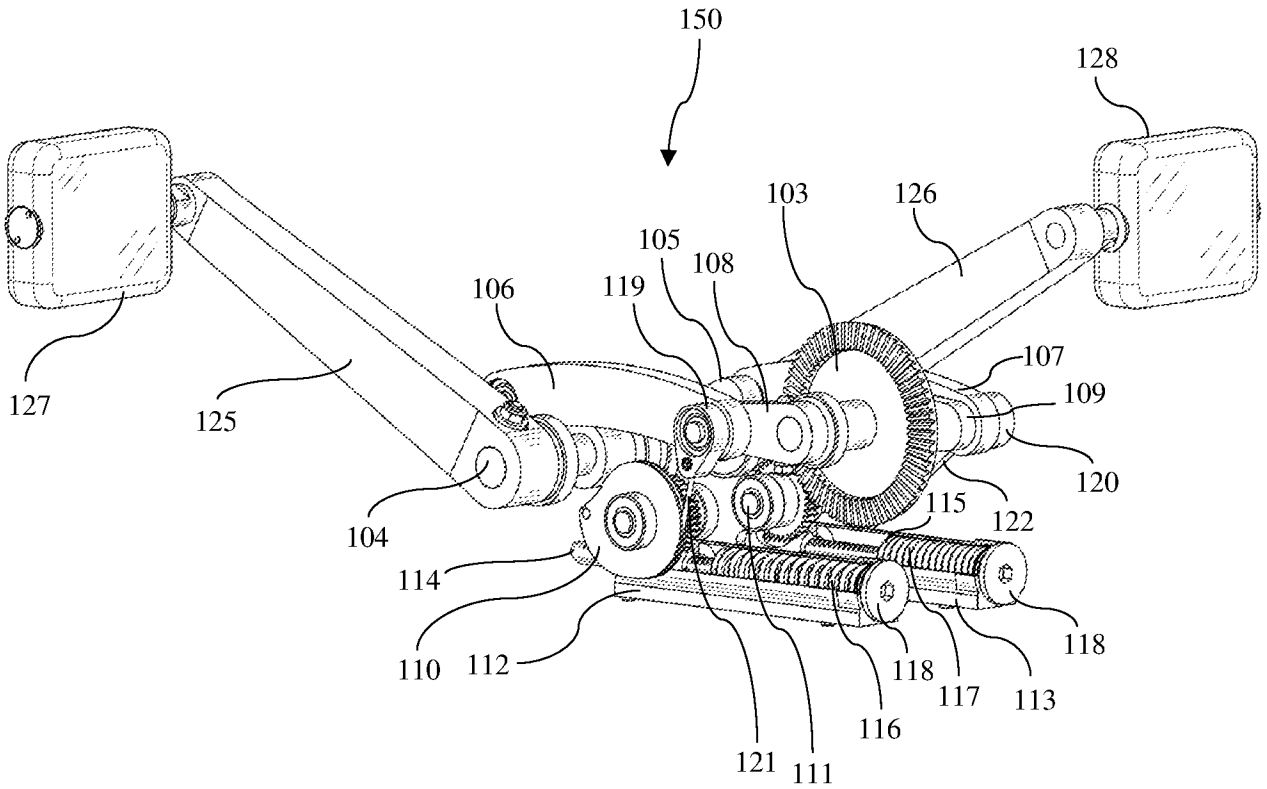
FIG. 4 is a perspective view of the dynamic components of the drive mechanism illustrated in FIG. 2.

Referring now to FIG. 4 which is a perspective view of the components of the drive mechanism 150 with structural elements such as, transmission case 101, 102, bearing plates 123, 124, transmission cover 133, transmission cover retainer plate 130, and spring cylinder cover plate 129 hidden from view. Right side spring cylinder 112 and left side spring cylinder 113 are partially sectioned to illustrate the positional relationship of the secondary biasing system: springs 116, 117, piston and gear rack 114, 115, cable spool and pinion 110, 111, cables 121, 122, and cable end receivers 119, 120. Timing of the secondary system is dictated by the rotational position of receiver cranks 108, 109 which are rigidly affixed to crank shaft with cog 103 which is itself rotationally mounted within the transmission case 101, 102. The distal end of each receiver crank 108, 109 is alternately driven by connecting rods 106, 107, rocker spindles 104, 105, and driver cranks 125, 126, by way of pedals 127, 128.

For a fuller understanding of the physical operation of the present invention reference is made to FIGS. 5A through 5F which are right side orthogonal views of the dynamic components of the system. Operation of the left side is exactly the same with a phase shift of 180 degrees. For ease of visualization, right and left secondary system torque vectors are included. In operation of the present invention, the advantageous differential in torque alternates and occurs twice per revolution, once per side, favoring the driven crank at bottom dead center.

Figure 5A:
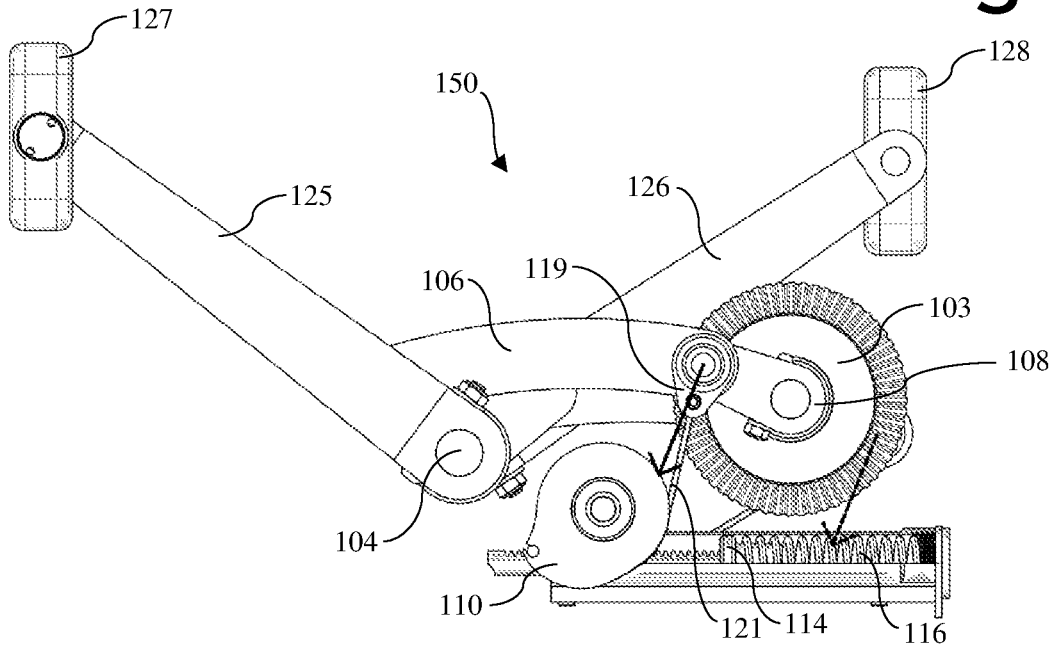

FIG. 5A depicts the dynamic components of the drive mechanism 150 of the present invention in one of the two rest positions. The second being at a rotation of 180 degrees of the crankshaft with cog 103. The torques imparted upon the crankshaft with cog 103 are equal and opposite and therefore cancel. From this starting position force applied to pedal 127 rotates right side driver crank arm 125 and rocker spindle 104 clockwise (as viewed) thus driving connecting rod 106 forward and receiver crank 108 clockwise. This draws tension upon cable 121 by position of right side cable receiver 119 and drives cable spool and pinion 110 counterclockwise, in turn pushing piston and gear rack 114 forward compressing spring 116. Left pedal 128 and crank arm 126 are in their transfer stroke and crank arm 126 correspondingly rotates counterclockwise.

Figure 5B:
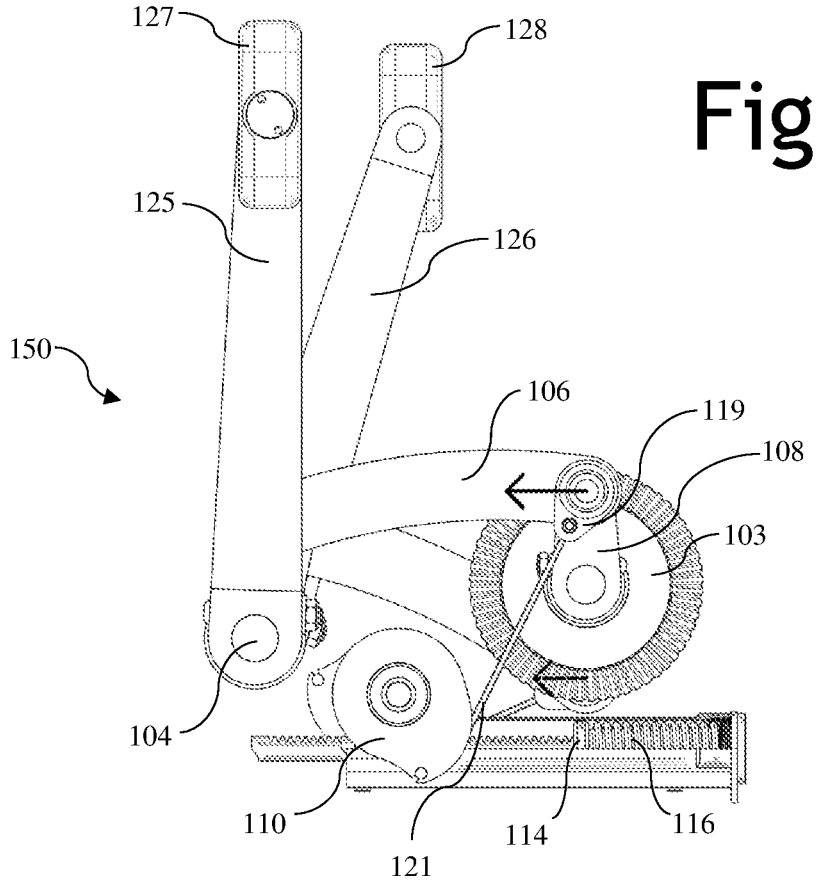

FIG. 5B depicts the dynamic components of the drive mechanism 150 of the present invention when the right side receiver crank 108 is 90 degrees beyond top dead center. In this position force applied to pedal 127 rotates right side driver crank arm 125 and rocker spindle 104 clockwise (as viewed) thus driving connecting rod 106 forward and receiver crank 108 and crank shaft with cog 103 clockwise. By position of right side cable end receiver 119, more tension is drawn upon cable 121 and right side cable spool and pinion 110 is driven further counterclockwise in turn pushing piston and gear rack 114 forward compressing spring 116 further. At this point most of the work has been done on the right side spring as the piston gear rack is nearing the end of its travel. Left pedal 128 and crank arm 126 continue in their transfer stroke and crank arm 126 correspondingly rotates counterclockwise.

Figure 5C:
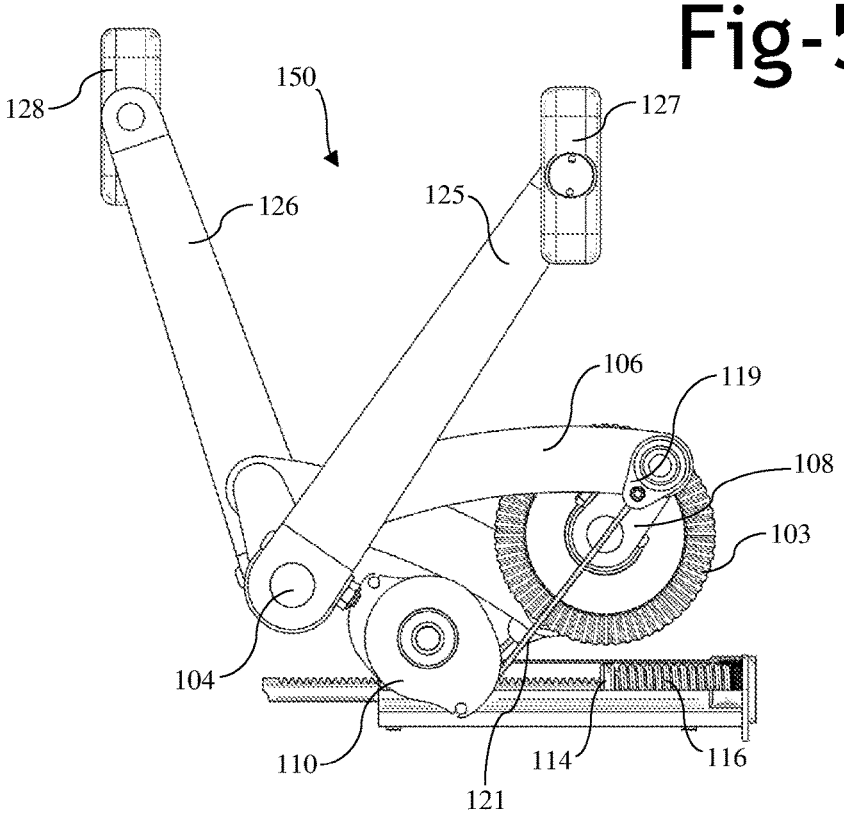

FIG. 5C depicts the dynamic components of the drive mechanism 150 of the present invention at top and bottom dead center of the secondary system. At this point the secondary system produces no torque on the primary system and right side cable 121 tension is at its maximum as cable spool and pinion 110 has rotated fully counterclockwise driving piston and gear rack 114 to fully compress spring 116. Continued force applied to pedal 127 rotates right side driver crank arm 125 and right side rocker spindle 104 clockwise (as viewed) thus driving connecting rod 106 forward and receiver crank 108 and crankshaft and cog 103 clockwise. As the right side secondary passes its top dead center, the tension upon the right side cable 121 will begin to provide a torque on crank shaft with cog 103 in the clockwise direction and as receiver crank 108 and cable end receiver 119 continues to rotate the angle of action between receiver crank 108 and cable 121 continues to improve. Left pedal 128 and left driver crank arm 126 continue in their transfer stroke and crank arm 126 correspondingly rotates counterclockwise.

Figure 5D:
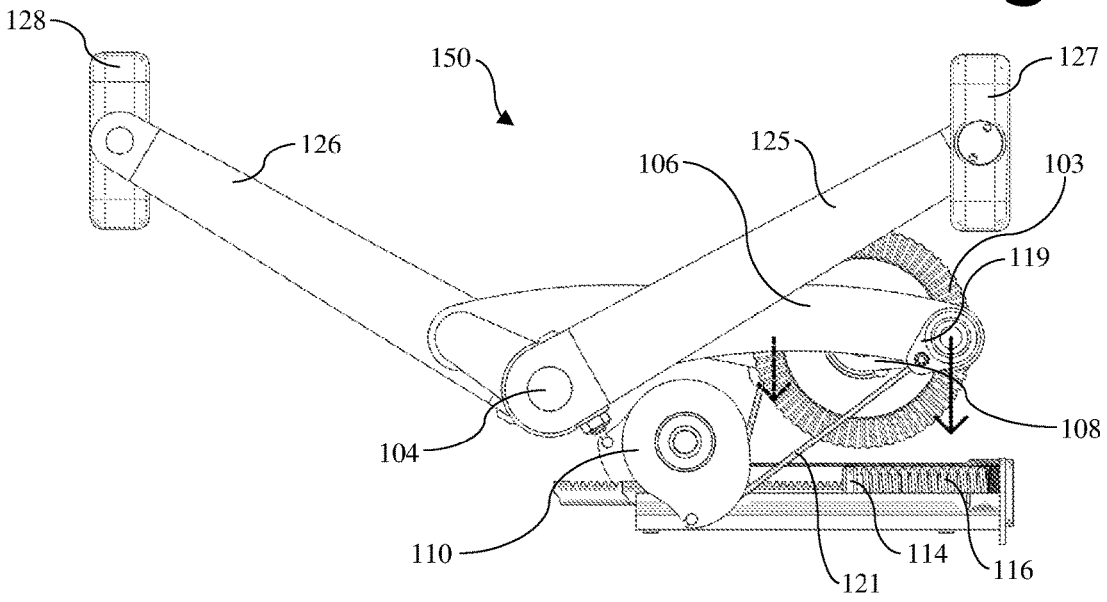

FIG. 5D depicts the dynamic components of the drive mechanism 150 of the present invention as the primary system is at top and bottom dead center as can be seen in the position of right side rocker spindle 104, right side connecting rod 106 and right side receiver crank 108. At this point no effort applied to either pedal 127, 128 will produce a torque to keep the crankshaft with cog 103 rotating. However, there remains a significant amount of tension in the cable 121 as can be seen by the position of right side spring 116, piston and gear rack 114, right side cable spool 110, and right side cable end receiver 119. The line of action of cable 121 to receiver crank 108 has improved significantly whereas cable tension in the left hand side is near minimum. This results in a positive torque bias in the secondary system that drives the crank shaft with cog 103 clockwise (as viewed) through right side bottom dead center thus transitioning right side crank 125 from power stroke to transfer stroke and left side crank 126 from transfer stroke to power stroke.

FIG. 5E depicts the dynamic components of the drive mechanism 150 of the present invention when the right side receiver crank 108 is 270 degrees beyond top dead center. In this position force applied to pedal 128 rotates left driver crank arm 126 and rocker spindle 105 clockwise (as viewed) thus driving connecting rod 107 forward and receiver crank 109 and crankshaft with cog 103 clockwise. This draws more tension upon cable 122 and drives left side cable spool and pinion 111 (not shown) counterclockwise in turn pushing piston and gear rack 115 (not shown) forward compressing spring 117 (not shown). At this point most of the work has been done on the left side spring as the piston gear rack is nearing the end of its travel. The position of right side cable end receiver 119 moves closer to right side cable spool and pinion 110 causing it to rotate clockwise as piston and gear rack 114 move back responding to spring 116 which further reduces tension upon right side cable 121. Right pedal 127 and crank arm 125 continue in their transfer stroke and crank arm 125 correspondingly rotates counterclockwise.

FIG. 5F depicts the dynamic components of the drive mechanism 150 of the present invention as the primary system is at its other top and bottom dead center as can be seen in the position of left side rocker spindle 105, left side connecting rod 107 and left side receiver crank 109. At this point no effort applied to either pedal 127, 128 will produce a torque to keep the crankshaft with cog 103 rotating. However, there remains a significant amount of tension in the cable 122 and the line of action of cable 122 to receiver crank 109 has improved significantly whereas cable tension in the right side cable 121 is near minimum as can be seen by the position of right side spring 116, piston and gear rack 114, right side cable spool 110, and right side cable end receiver 119. This results in a positive torque bias in the secondary system that drives the crank shaft with cog 103 clockwise (as viewed) through left bottom dead center thus transitioning right side crank 125 from transfer stroke to power stroke and left side crank 126 from power stroke to transfer stroke.

Figure 6:
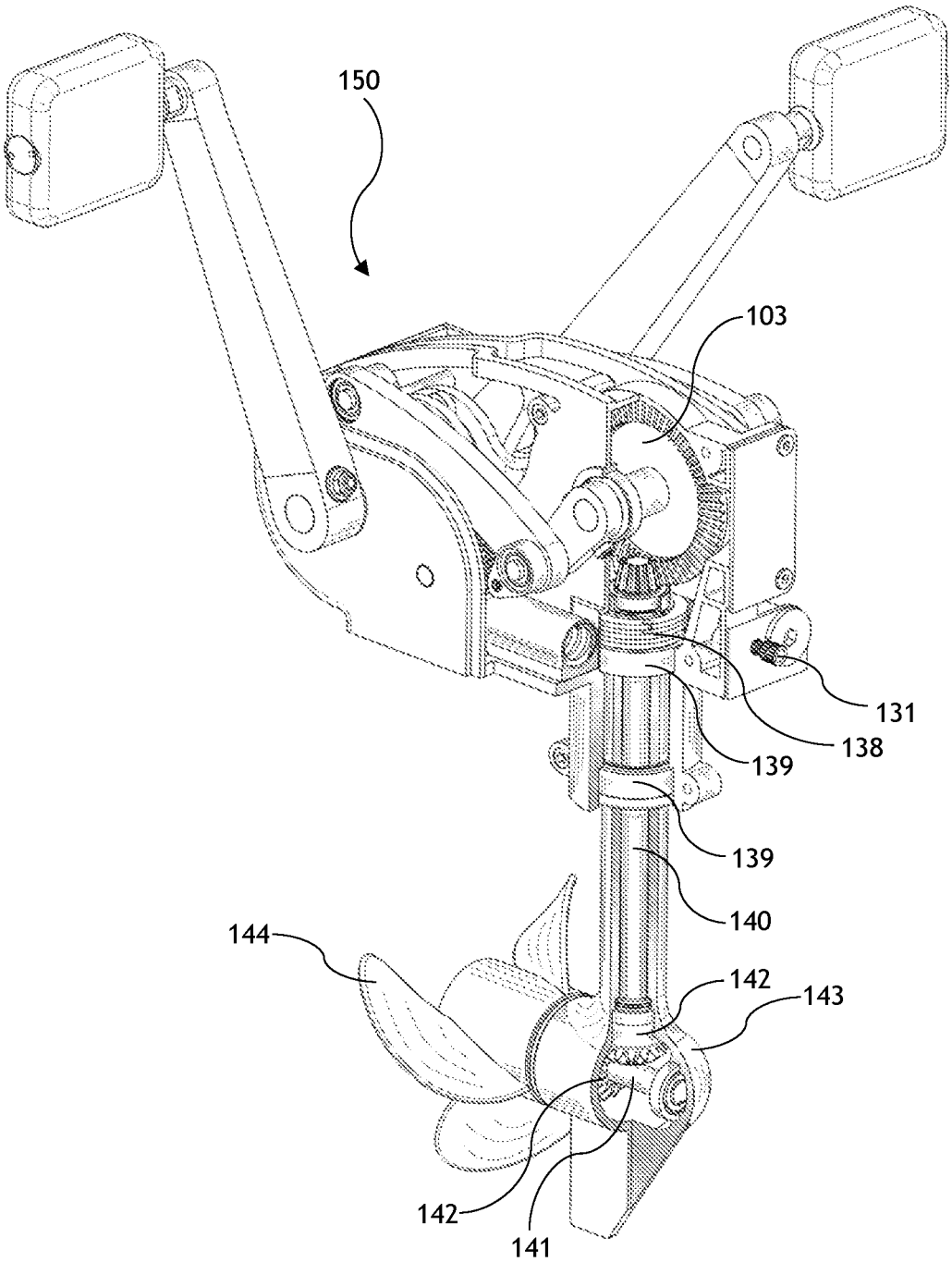
FIG. 6 is a partially sectioned perspective view of the drive mechanism configured to drive a propeller illustrated in FIG. 2.

Referring now to FIG. 6 which is a partially sectioned view illustrating the application of the drive mechanism 150 of the present invention to drive a propeller 144 with directional thrust capability. The lower gearbox case 143 is rotationally coupled to the drive mechanism 150 by headset bearings 139. Power is transmitted from the crank and cog 103 to upper drive shaft with pinion 140 and then to lower drive shaft 141 through miter gears 142. The lower drive shaft 141 is rigidly coupled to the propeller 144 which provides thrust to drive the craft. Directional cable spool 138 and adjusting barrels 131, 132 (not shown) accommodate counter-wound directional control cables for steering.

Figure 7:
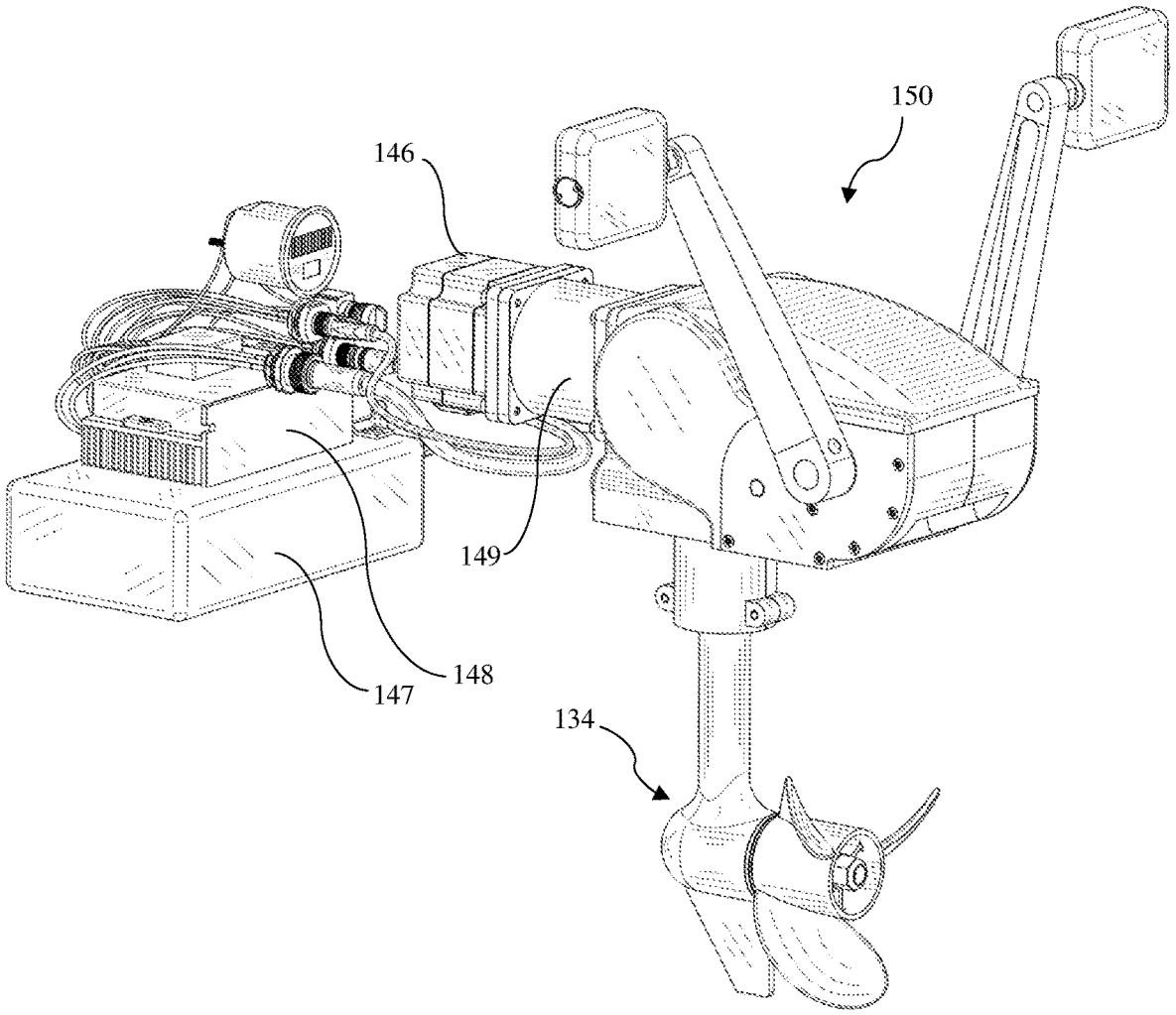
FIG. 7 is a perspective view of the drive mechanism configured to drive a propeller illustrated in FIG. 2 provisioned for electric assist.

Referring now to FIG. 7 which is a perspective view of the drive mechanism 150 equipped with lower gearbox assembly 134 for directional thrust capability and electric assist. An electric motor 146 and motor gearbox 149 may be directly mounted to the drive mechanism 150 to amplify the power input by the operator by means of motor controller 148 and electrical energy supplied by battery 147.

Figure 8A:
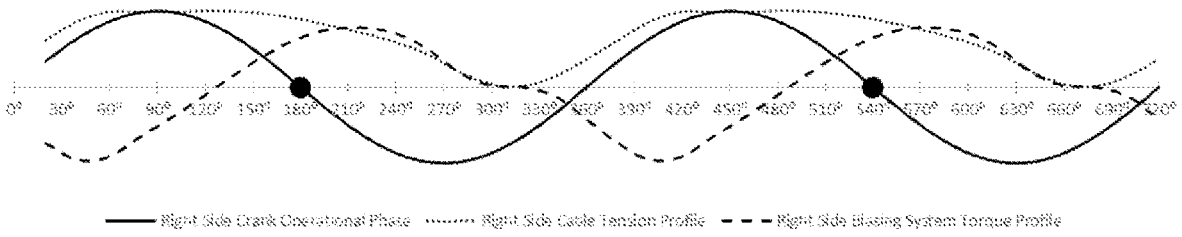
FIGS. 8A and 8B are charts illustrating the tension and torque profiles effected by the secondary system of the drive mechanism.
Figure 8B:
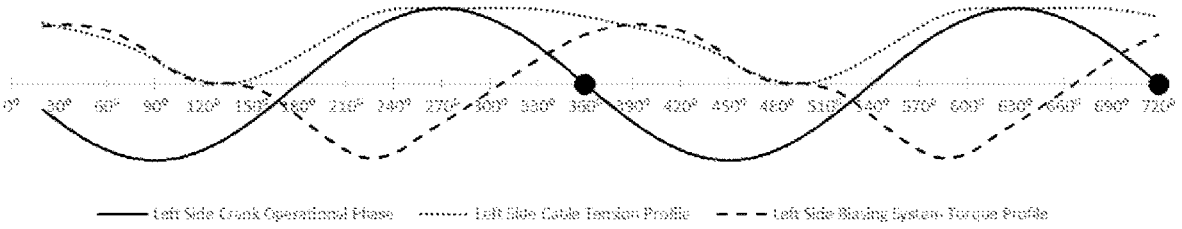

Referring now to FIGS. 8A and 8B, which show the phase relationship between the position of the primary driven crank, the secondary cable tension profile, and the secondary torque profile of drive mechanism 150. One of two potential rest positions is depicted with the right side in its power stroke and the left side in its transfer stroke. Bottom dead centers are indicated with bullets. Beginning from rest, the right side driven crank is driven forward by effort of the operator. A portion of the work done by the operator serves to increase the right side cable tension as the right side biasing spring is compressed. This cable tension reaches maximum and produces a positive torque as the driven crank passes the top dead center of the secondary system at approximately 130 degrees. At the same time the left side driven crank is passing the bottom dead center of the secondary system and begins to produce a smaller negative torque as cable tension on the left side is near minimum. As the right side driven crank approaches its bottom dead center, the torque differential between right and left secondary systems provides the necessary force to transition from power to transfer stroke. Likewise, the left hand side transitions from transfer stroke to power stroke. The process is the same for both sides and obviously repeats harmonically.

Figure 9:
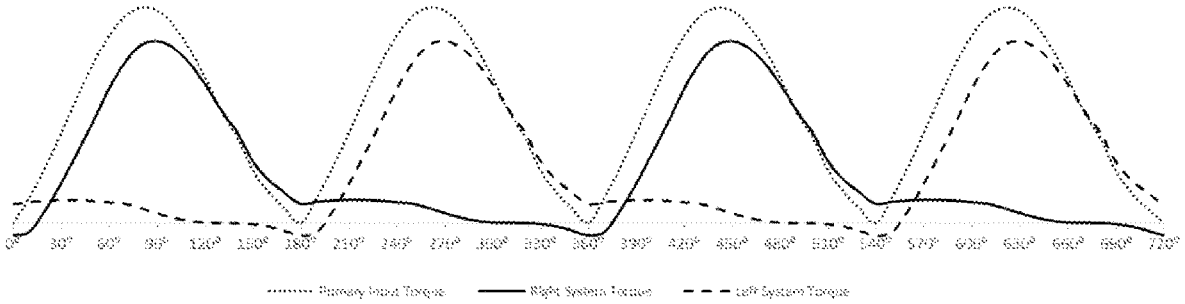
FIGS. 9 and 10 are charts illustrating the interaction between secondary and primary systems and the representative system torque profiles for the drive mechanism.
Figure 10:
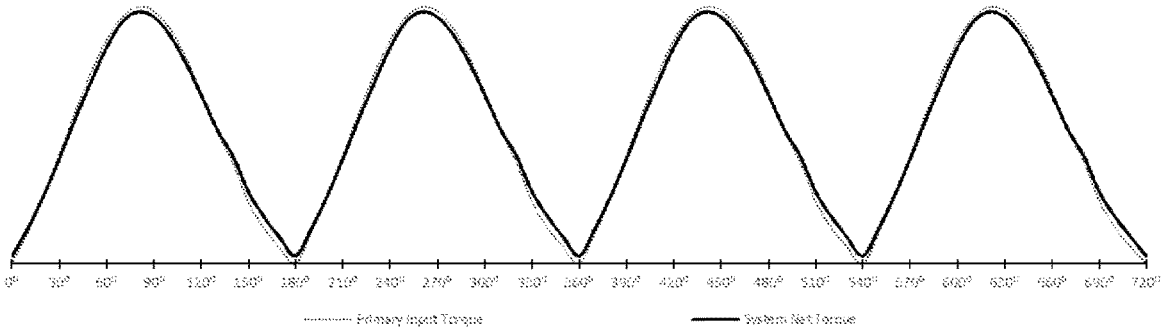

Referring now to FIGS. 9 and 10 which illustrate the interaction between primary and secondary systems of drive mechanism 150. Right and left power strokes represented as primary input torque illustrate the effective torque contribution of the primary system. FIG. 9 illustrates the combined torque profile for primary and secondary systems for each respective side. The work in and out of the secondary system can clearly be seen in the leading and trailing regions of each power stroke. FIG. 10 illustrates the net result by superposition and the advantageous energy transfer geometrically focused about the critical points of the rigidly driven system Therefore, the foregoing is considered as illustrative of the principles of the present invention in its preferred embodiment. Further, various modifications may be made of the invention without departing from the scope thereof and it is desired, therefore, that only such limitations shall be placed thereon as are imposed by the prior art and which are set forth in the appended claims.

What is claimed is:

1. A transmission for a human-powered vehicle, the transmission comprising:

a primary system including a transmission case, a crankshaft with cog constrained to rotate about its axis within said transmission case and rigidly coupled to a pair of receiver cranks having distal ends offset by approximately 180 degrees, a pair of oscillating driver cranks each pivotally constrained to oscillate in a reciprocating manner about a respective proximal axis within said transmission case a distance from said crankshaft with cog, wherein each said driver crank is configured to receive a reciprocating input force at its distal end, a pair of connecting rods, each configured to transmit the reciprocating input force from a respective one of said driver cranks to a respective one of said receiver cranks, thereby converting the reciprocating input force into unidirectional rotary motion at the crankshaft; and a secondary biasing system operably engaged with said crankshaft with cog to provide a torque around the top and bottom dead centers of the primary system.

2. A transmission for a human-powered vehicle as claimed in claim 1, wherein said cog is a ring gear, and further comprising;

an output shaft with a pinion driven by said ring gear.

3. A transmission for a human-powered vehicle as claimed in claim 1, wherein said cog is a chain wheel, and further comprising;

a chain driven by said chain wheel.

4. A transmission for a human-powered vehicle as claimed in claim 1, wherein said cog is a belt pulley, and further comprising;

a belt driven by said belt pulley.

5. A transmission for a human-powered vehicle as claimed in claim 1, and further comprising;

an electric motor;

a motor controller; and a battery.

6. A transmission for a human-powered vehicle as claimed in claim 1, and further comprising;

a lower gearbox; and a propeller.

7. A transmission for a human-powered vehicle as claimed in claim 2, and further comprising;

a rotatable and steerable lower gearbox; and a propeller.

8. A transmission for a human-powered vehicle as claimed in claim 1, wherein said secondary biasing system includes at least one spring.

9. A transmission for a human-powered vehicle as claimed in claim 1, wherein said secondary biasing system includes at least one battery.

10. A transmission for a human-powered vehicle as claimed in claim 1, wherein said secondary biasing system includes at least one capacitor.

11. A transmission for a human-powered vehicle as claimed in claim 1, wherein said secondary biasing system includes at least one suspended mass.

* * * * *